US007357625B2

(12) United States Patent
Yen

(10) Patent No.: US 7,357,625 B2
(45) Date of Patent: Apr. 15, 2008

(54) PUSH ROD IN AN ELECTRICAL PUMP ADAPTED FOR USE WITH A PISTON ROD IN AN AIR NOZZLE

(75) Inventor: Stanley Yen, Taipei (TW)

(73) Assignee: Ho Lee Co., Ltd., Tan-Shui Chen, Taipei Hsien (TW)

( * ) Notice: Subject to any disclaimer, the term of this patent is extended or adjusted under 35 U.S.C. 154(b) by 524 days.

(21) Appl. No.: 11/155,207

(22) Filed: Jun. 16, 2005

(65) Prior Publication Data

US 2005/0232793 A1 Oct. 20, 2005

Related U.S. Application Data

(63) Continuation-in-part of application No. 10/410,223, filed on Apr. 8, 2003, now abandoned.

(51) Int. Cl.
*F04B 17/03* (2006.01)

(52) U.S. Cl. ..... 417/423.1

(58) Field of Classification Search ..... 5/706, 5/713; 251/149.9; 417/423.1, 423.14
See application file for complete search history.

(56) References Cited

U.S. PATENT DOCUMENTS

| | | | | |
|---|---|---|---|---|
| 4,766,628 | A | 8/1988 | Walker | 5/706 |
| 6,530,751 | B1 | 3/2003 | Song et al. | 417/423.1 |
| 6,550,086 | B2 | 4/2003 | Boyd | 5/706 |
| 6,679,686 | B2 | 1/2004 | Wang | 417/423.1 |
| 6,709,246 | B2 | 3/2004 | Boyd | 417/423.1 |

*Primary Examiner*—Michael Koczo, Jr.
(74) *Attorney, Agent, or Firm*—James H. Walters

(57) ABSTRACT

An electrical pump adapted for use with a piston rod in an air nozzle has an electromagnetic valve board with an electromagnetic valve thereon. A Z-shaped push rod is provided to be adapted to be driven by the electromagnetic valve so as to drive the piston rod to move accordingly. The movement of the Z-shaped push rod allows air from the electrical pump to be pumped into an object to be inflated/deflated when the motor is running depending on whether the inlet or the outlet is in alignment with the nozzle assembly of the nozzle assembly.

1 Claim, 6 Drawing Sheets

PUSH ROD IN AN ELECTRICAL PUMP ADAPTED FOR USE WITH A PISTON ROD IN AN AIR NOZZLE

CROSS REFERENCE

This application is a continuation-in-part of application filed on Apr. 8, 2003 now abandoned by the same applicant, with the Ser. No. 10/410,223. The content thereof is thus hereinafter incorporated for reference.

BACKGROUND OF THE INVENTION

1. Field of the Invention

The present invention relates to a push rod, and more particularly to a push rod in the electrical pump so that the push rod is able to be driven by an electromagnetic valve actuator in the electrical pump to push the piston rod in an air nozzle to activate inflation/deflation of an object having the air nozzle mounted therein.

2. Description of Related Art

In the past, when a user tried to inflate an object, a pump was definitely required to pump the air into the object. However, when deflating the object was required, the user then had to use both hands to compress and deflate the object.

Using hands to deflate the object is practical if the object is small in size but when the object is large in size, e.g. an air mattress, the effort required to deflate object may then last for quite a long time. To overcome the shortcoming of using hands to deflate the object, an air nozzle is mounted on the object so that when deflation of the object is required, the user just pushes backward the piston rod inside the object whereby the movement of the piston rod inside the object opens the air nozzle such that due to the pressure inside the object being larger than that outside the object, air flows quickly to outside the object.

Still, using this method is troublesome because every time the user has to manually push the piston rod backward into the object to deflate the object even though there is an electrical pump on the side.

To overcome the shortcomings, the present invention tends to provide an improved electrical pump to mitigate and obviate the aforementioned problems.

SUMMARY OF THE INVENTION

The primary objective of the present invention is to provide an improved electrical pump with a push rod adapted to be engaged with the piston rod in an air nozzle on an object to be inflated/deflated such that the push rod is able to be driven by an electromagnetic valve actuator in the electrical motor to accomplish the required purposes.

In a different aspect of the present invention, the electrical pump is provided with a micro-adjustment switch to control movement of the push rod without activating operation of the motor so as to proceed with air discharge from the inflated object.

Still in another aspect of the present invention, the electrical pump has an air inlet adapted to be selectively connected to the air nozzle to proceed with fast air discharge from the object.

Other objects, advantages and novel features of the invention will become more apparent from the following detailed description when taken in conjunction with the accompanying drawings.

DETAILED DESCRIPTION OF THE PREFERRED EMBODIMENT

Figure 1:
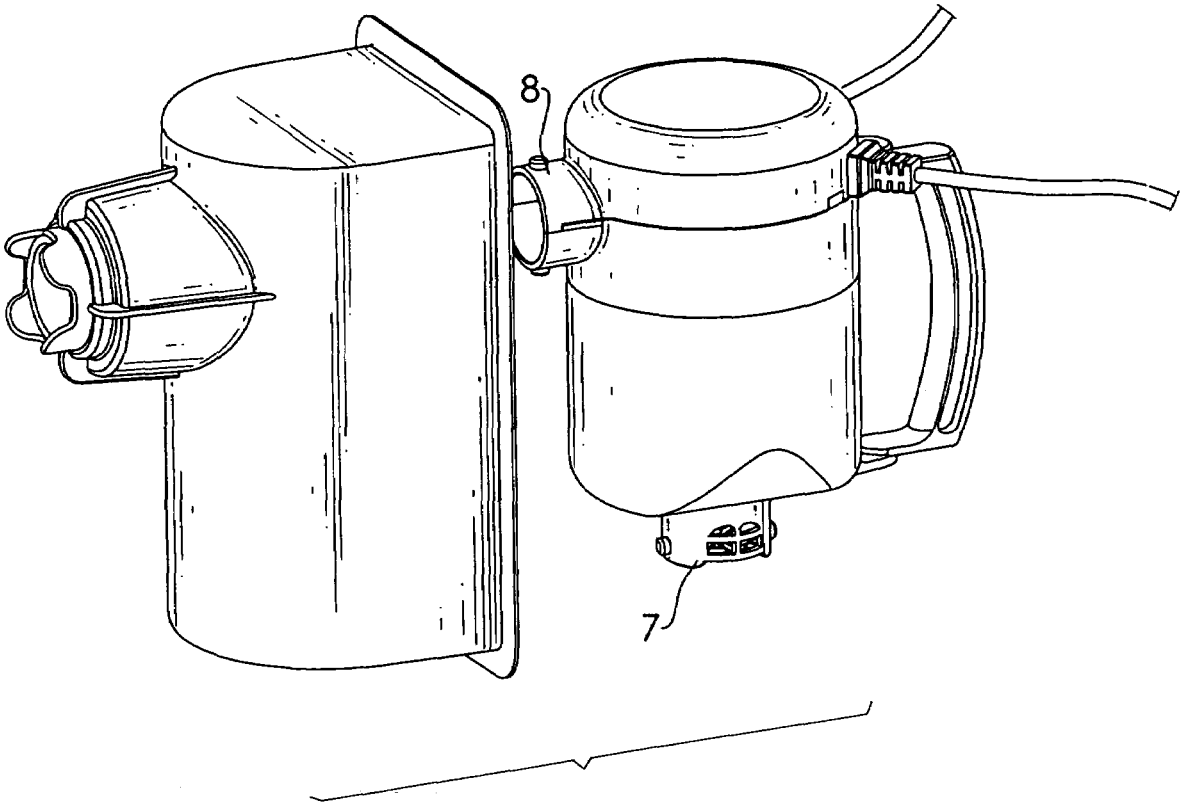
FIG. 1 is a perspective view of the electrical pump of the present invention and a nozzle assembly mounted in an object to be inflated/deflated.
Figure 2:
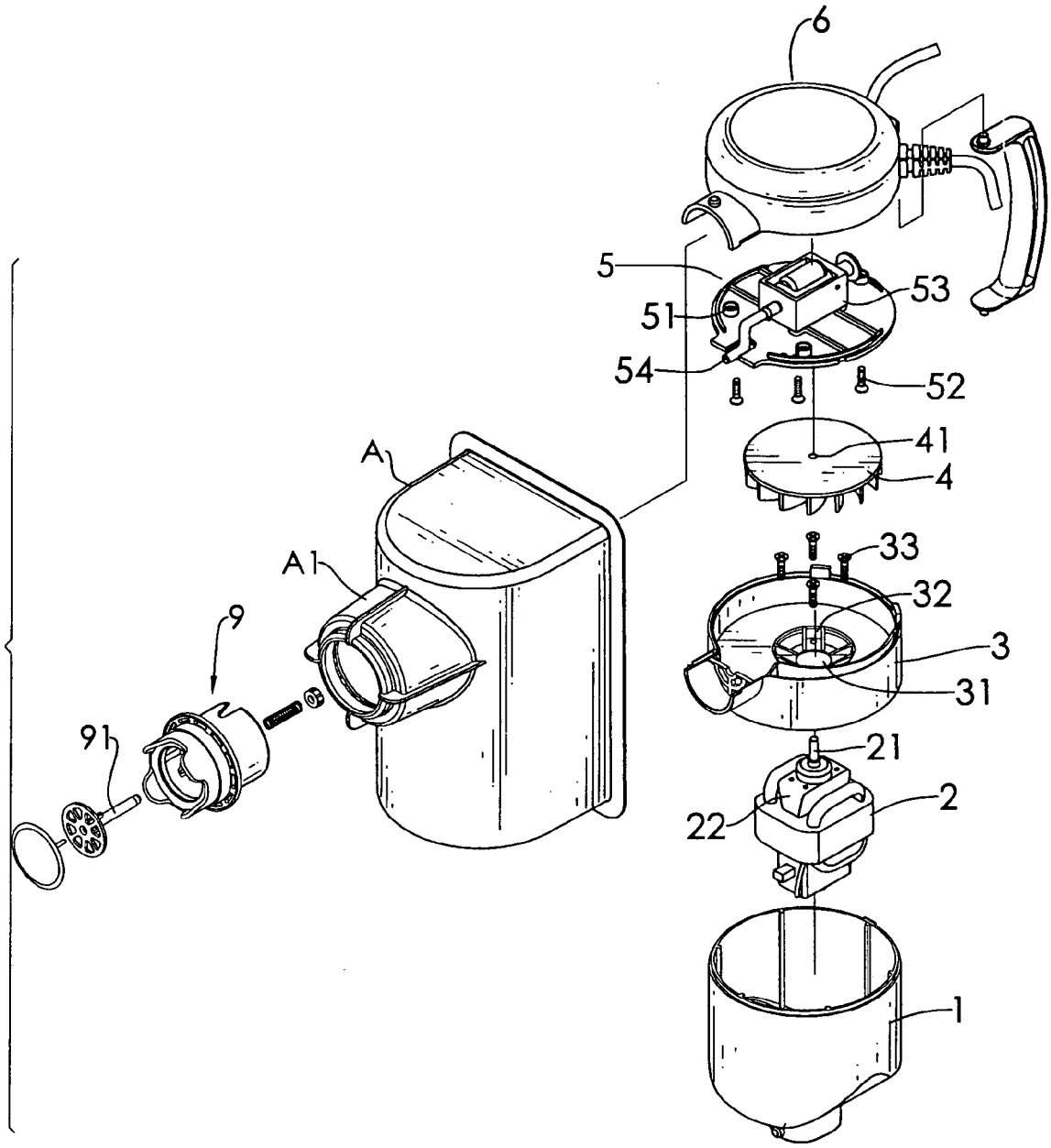
FIG. 2 is an exploded perspective view showing the electrical pump and the nozzle assembly shown in FIG. 1.

With reference to FIGS. 1 and 2, an electrical pump in accordance with the present invention includes a cylindrical base (1), a motor (2), a motor bracket (3), a blade assembly (4), an electromagnetic valve board (5) and a cover (6).

The base (1) has a closed end and an open end.

The motor (2) has a motor shaft (21) extending out of the motor (2) and multiple threaded holes (22) defined in a top face of the motor (2).

The motor bracket (3) has a through hole (31) defined through a periphery of the motor bracket (3) to correspond to the motor shaft (21) extending outward from the motor (2) and multiple securing holes (32) in respective communication with the threaded holes (22) defined in the top face of the motor (2). Multiple first bolts (33) are provided to correspond to and extend into the securing holes (32) and the threaded holes (22) to secure the motor (2) to the motor bracket (3).

The blade assembly (4) with multiple blades (not numbered) has a shaft hole (41) corresponding to the motor shaft (21) of the motor (2).

The electromagnetic valve board (5) has multiple positioning holes (51) defined through a periphery of the electromagnetic valve board (5), multiple second bolts (52) corresponding to and extending into the positioning holes (51), an electromagnetic valve actuator (53) securely mounted on top of the electromagnetic valve board (5) to generate a magnetic field when required and a Z-shaped push rod (54) in engagement with the electromagnetic valve actuator (53) but movable with respect to the electromagnetic valve actuator (53). The cover (6) has multiple legs (not shown) extending downward to correspond to the positioning holes (51) and the second bolts (52).

When in assembly, the motor shaft (21) is extended through the through hole (31) of the motor bracket (3) and the shaft hole (41) of the blade assembly (4). The first bolts (33) are extended into the securing holes (32) and the threaded holes (22) to securely engage the motor bracket (3) with the motor (2).

Then the second bolts (52) are extended into the positioning holes (51) of the electromagnetic valve board (5) with the electromagnetic valve actuator (53) mounted thereon to securely engage the electromagnetic valve board (5) with the cover (6).

Thereafter, the cover (6) with the electromagnetic valve board (5) is securely connected to the base (1) to sandwich the blade assembly (4), the motor bracket (3) and the motor (2) with the base (1). After assembly, it is noted that an inlet (7) and an outlet (8) are respectively formed on two adjacent side faces of the electrical pump of the present invention.

Furthermore, the nozzle assembly is provided with a casing (A) configured to receive therein the electrical pump of the present invention, a mouth (A1) formed and extending from a side face of the casing (A), a membrane device (9) movably received in the mouth (A1) to control communication between an object to be inflated/deflated and the outlet (8) (or the inlet (7)).

Figure 3:
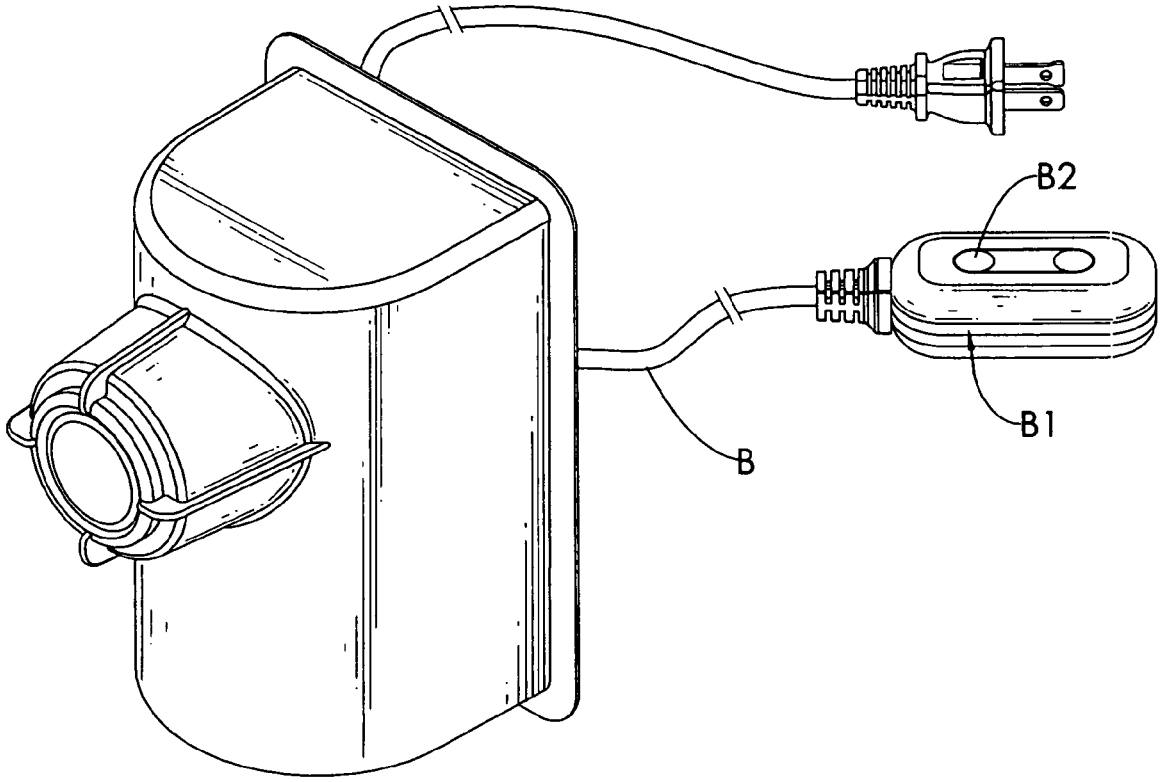
FIG. 3 is a perspective view showing that the electrical pump is received in the nozzle assembly for application.

With reference to FIG. 3, it is noted that after the electrical pump of the present invention is received in the casing (A), a control wire (B) with a proximal end electrically connected to the electrical pump and a distal end formed with a controller (B1) is provided so as to control operation of the electrical pump. The controller (B1) is provided with a micro-adjustment switch (B2) to energize the electromagnetic valve actuator (53) without the activation of the motor (52) so that the push rod (54) is able to move after the micro-adjustment switch (B2) is pressed.

Figure 4:
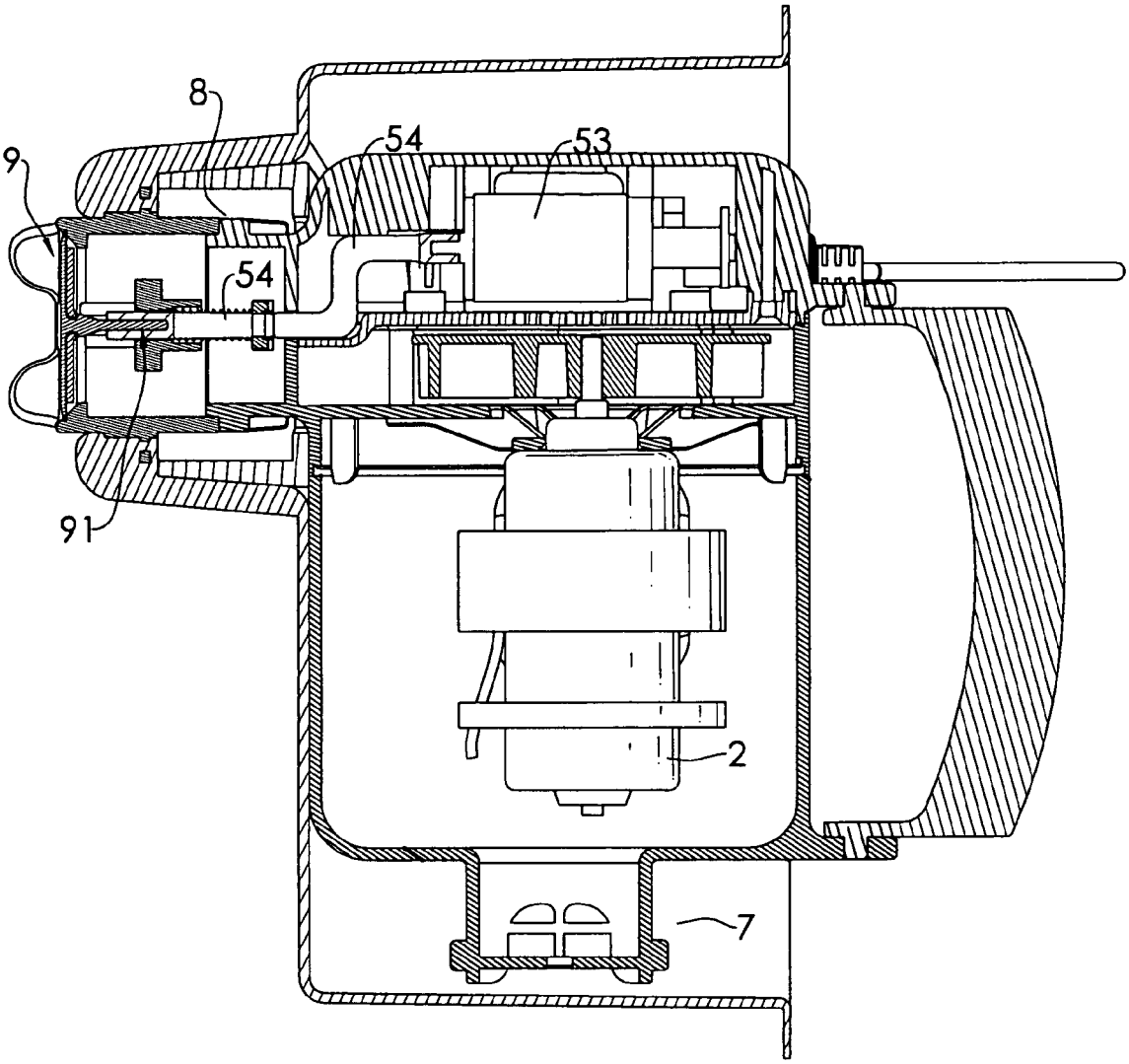
FIG. 4 is a schematic cross sectional view showing the interaction between the push rod of the electrical pump and the piston rod in the nozzle assembly.
Figure 5A:
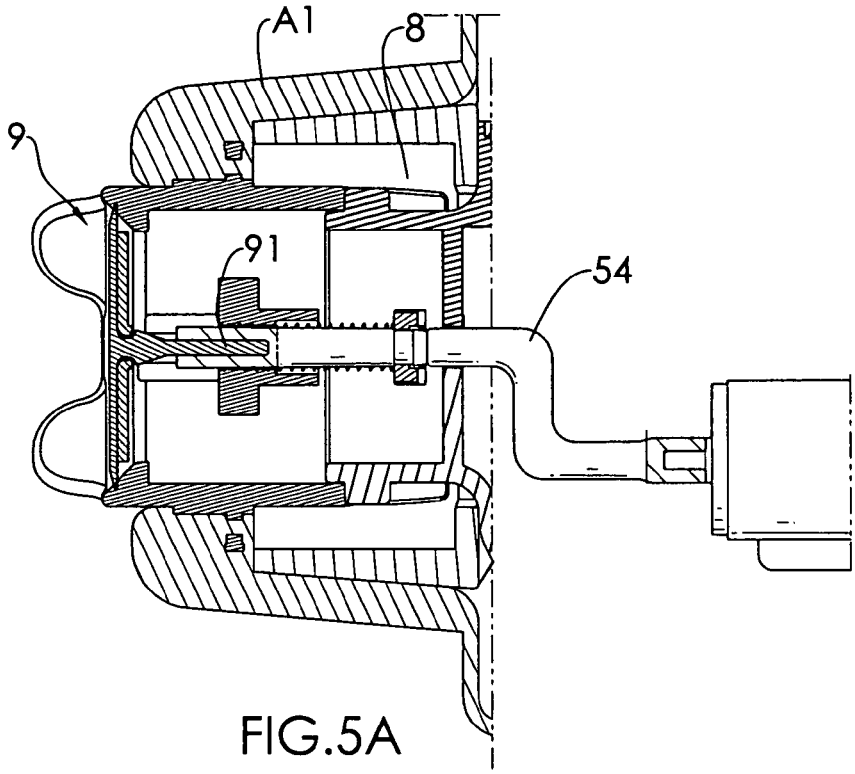
FIGS. 5A and 5B are enlarged cross sectional views showing the movement of the piston rod due to the operation of the push rod.
Figure 5B:
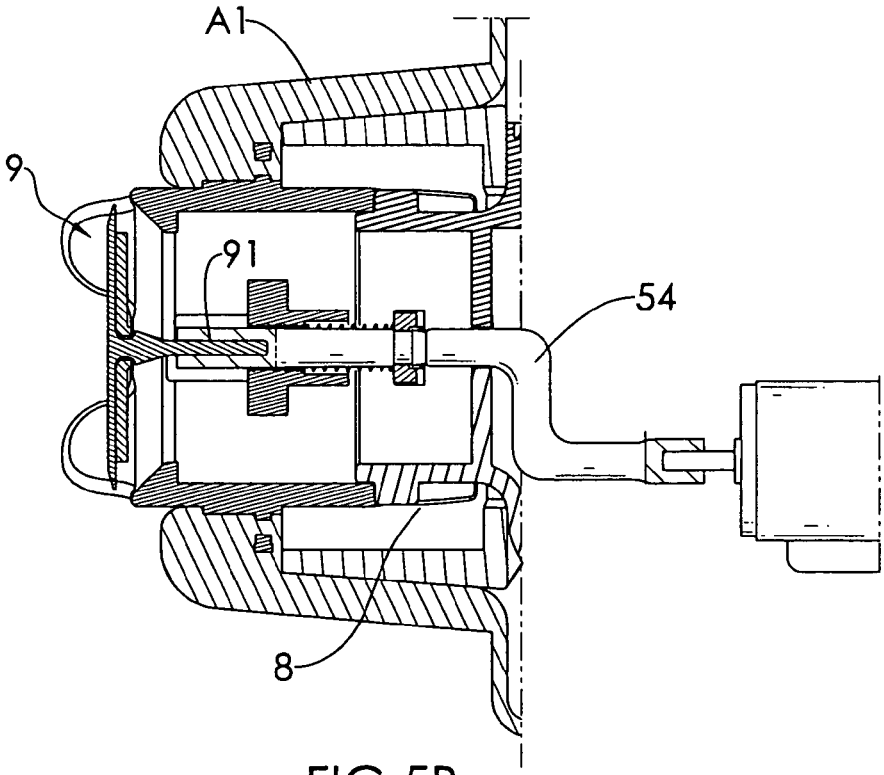
Figure 6:
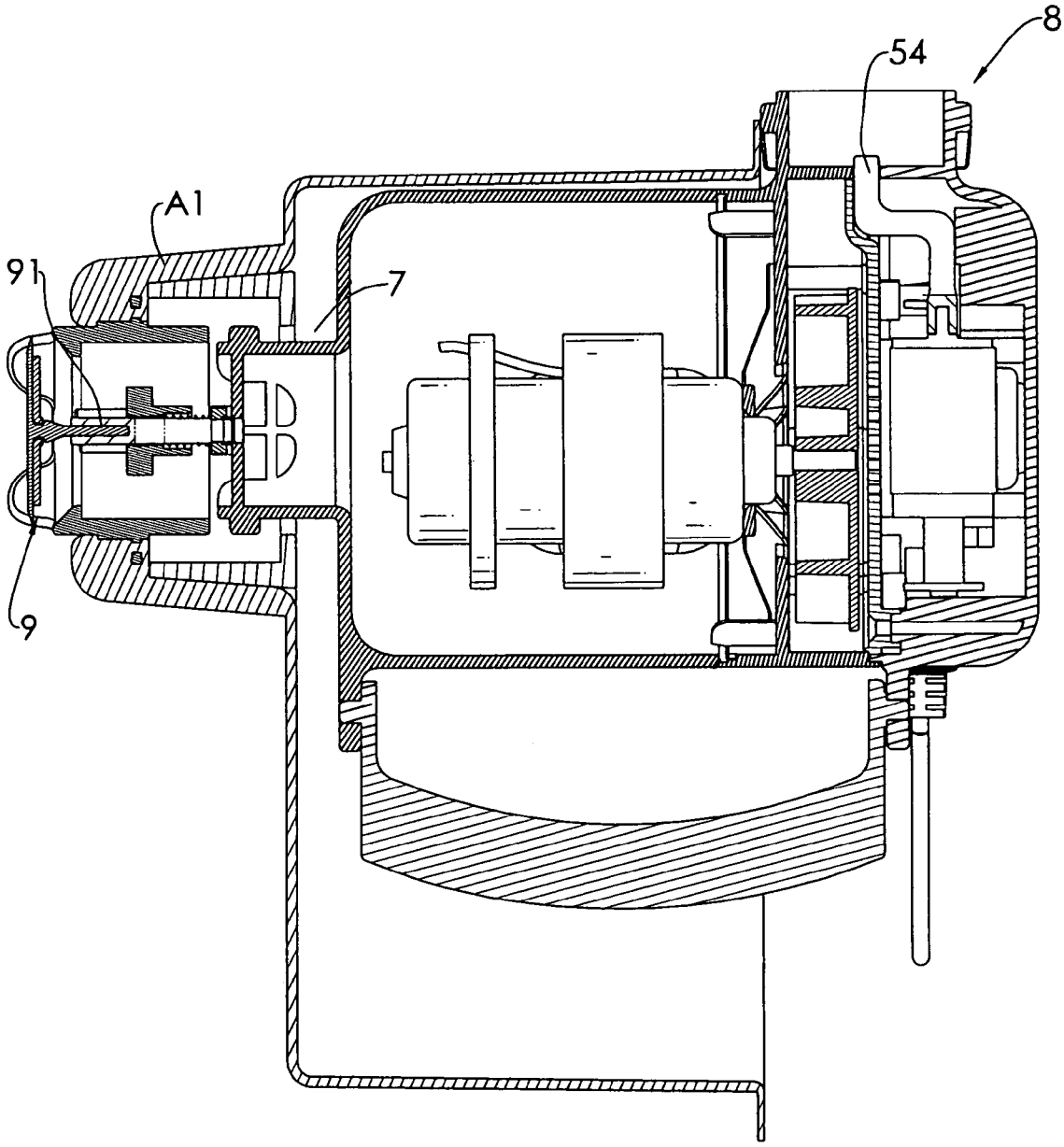
FIG. 6 is a schematic cross sectional view showing that the electrical pump is received in the nozzle assembly with the inlet connected to the nozzle of the nozzle assembly to proceed with fast air discharge from the object.

With reference to FIGS. 4, 5A and 5B, after the electrical pump is received in the nozzle assembly, the outlet (8) is received inside the mouth (A1) to allow the push rod (54) to abut against a spring-driven piston rod (91) of the membrane device (9). Therefore, when the push rod (54) is driven to move toward the piston rod (91) by the energized electromagnetic valve actuator (53), the piston rod (91) is pushed to open the mouth (A1) due to movement of the membrane device (9) inside the mouth (A1). After the mouth (A1) is opened, operation of the motor (2) starts inflating the object to be inflated from the outlet (8). It is noted that while the motor (2) operates, air is sucked into the electrical pump of the present invention via the inlet (7). During the inflation process, if the object is not available for application in that the air pressure inside the object is too great, the operator is able to use the controller (B1) to control the movement of the push rod (54) to shift the membrane device (9) away from engagement with an inner periphery of the mouth (A1) of the nozzle assembly without the activation of the motor (2) such that the air inside the object is able to automatically flow out of the object to accomplish a micro-adjustment objective with the object.

However, should the operator want to proceed with fast air discharge of the object, the operator turns the electrical pump of the present invention to align the inlet (7) with the mouth (A1) of the nozzle assembly. Therefore, after the motor (2) is activated, air inside the object is sucked into the inlet (7) and escapes from the outlet (8) so as to accomplish fast air discharge.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical pump adapted for use with a piston rod in a nozzle assembly, the electrical pump comprising:

a base;

a motor;

a motor bracket securely connected to the motor;

a blade assembly rotatably mounted on the motor bracket to be driven by the motor via a motor shaft extending out of the motor;

an electromagnetic valve board with an electromagnetic valve actuator thereon;

a cover securely connected to the electromagnetic valve board and the base to sandwich therebetween the motor, the motor bracket, the blade assembly and the electromagnetic valve board so as to form an inlet and an outlet, wherein a Z-shaped push rod is operably connected to the electromagnetic valve actuator so as to be driven by the electromagnetic valve actuator and to drive a piston rod in a nozzle assembly to move accordingly, in a situation where an object having therein the nozzle assembly is to be inflated, the inlet is for suction of air from ambient air and the outlet is structured for alignment with the nozzle assembly of the object so as to blow the air into the object and where the object is to be deflated, the inlet is structured for alignment with the nozzle assembly of the object for sucking the air inside the object and the outlet is for venting the air sucked in via the inlet, thereby allowing air from the electrical pump to be pumped into or away from the object to be inflated/deflated when the motor is running.

* * * * *